US005271447A

United States Patent [19]

Aronovich

[11] Patent Number: 5,271,447

[45] Date of Patent: Dec. 21, 1993

[54] UNIVERSAL COVERING CASE AND METHOD FOR MODIFYING EXISTING BLIND ASSEMBLIES

[75] Inventor: Alexander Aronovich, Brooklyn, N.Y.

[73] Assignee: LO-CO Advertising, Inc., New York, N.Y.

[21] Appl. No.: 991,531

[22] Filed: Dec. 16, 1992

Related U.S. Application Data

[63] Continuation-in-part of Ser. No. 864,239, Apr. 6, 1992, abandoned.

[51] Int. Cl.[5] ..... E06B 3/06

[52] U.S. Cl. ..... 160/236; 160/900

[58] Field of Search ..... 160/236, 900, 166.1, 160/176.1, 178.1, 168.1; 29/24.5

[56] References Cited

U.S. PATENT DOCUMENTS

| | | | |
|---|---|---|---|
| 4,884,616 | 12/1989 | Setele | 160/236 |
| 5,086,823 | 2/1992 | Danchulis et al. | 160/236 |
| 5,105,870 | 4/1992 | Merjane | 160/236 |
| 5,141,042 | 8/1992 | Schwaegerle | 160/236 |

*Primary Examiner*—Blair M. Johnson
*Attorney, Agent, or Firm*—Peter A. Borsari

[57] ABSTRACT

The present invention relates to a universal decorative covering case and method for modifying or altering existing horizontal or vertical blinds, louvers and the like. The universal covering case particularly is designed to conform to any preexisting vertical or horizontal louver assembly. In a preferred embodiment, the universal covering case of the present invention comprises a transparent case which is designed to individually enclose a slat of an existing vertical blind assembly, thereby creating a three-layer "sandwich" effect. On either one or both sides of the slat and between the slat and transparent covering case, a decorative insert is positioned. The decorative insert may be any web material that provides the desired decorative intent, such as paper, fabric, plastic film, and the like. The universal covering case can be easily and quickly installed onto any existing louver assembly without the use of any special tools or exceptional skills. The decorative insert, in the form of a partial strip or section of a larger image or design, is simply positioned between the slat and opposing transparent covering case. When the universal covering case is installed onto each of the slats of the existing blind assembly, an integrated or complete image, design or the like is created when the thus-covered slats are viewed in their entirety. In an alternative embodiment, the universal covering case is in the form of an installation kit containing a plurality of pre-selected, pre-positioned decorative inserts.

15 Claims, 3 Drawing Sheets

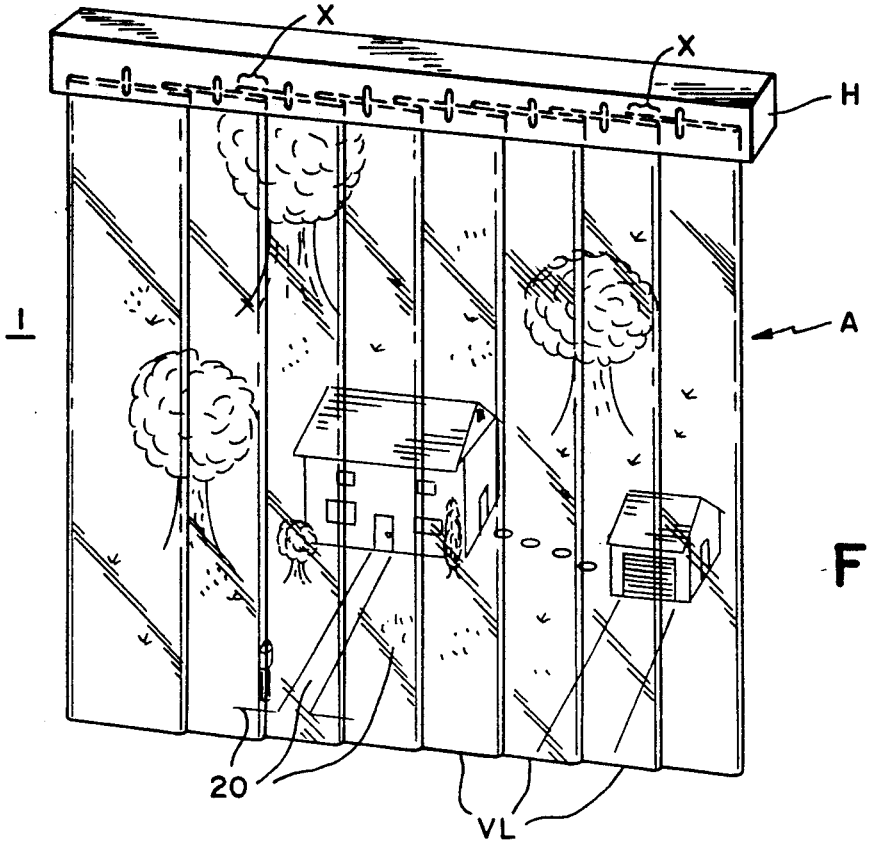
FIG. 1
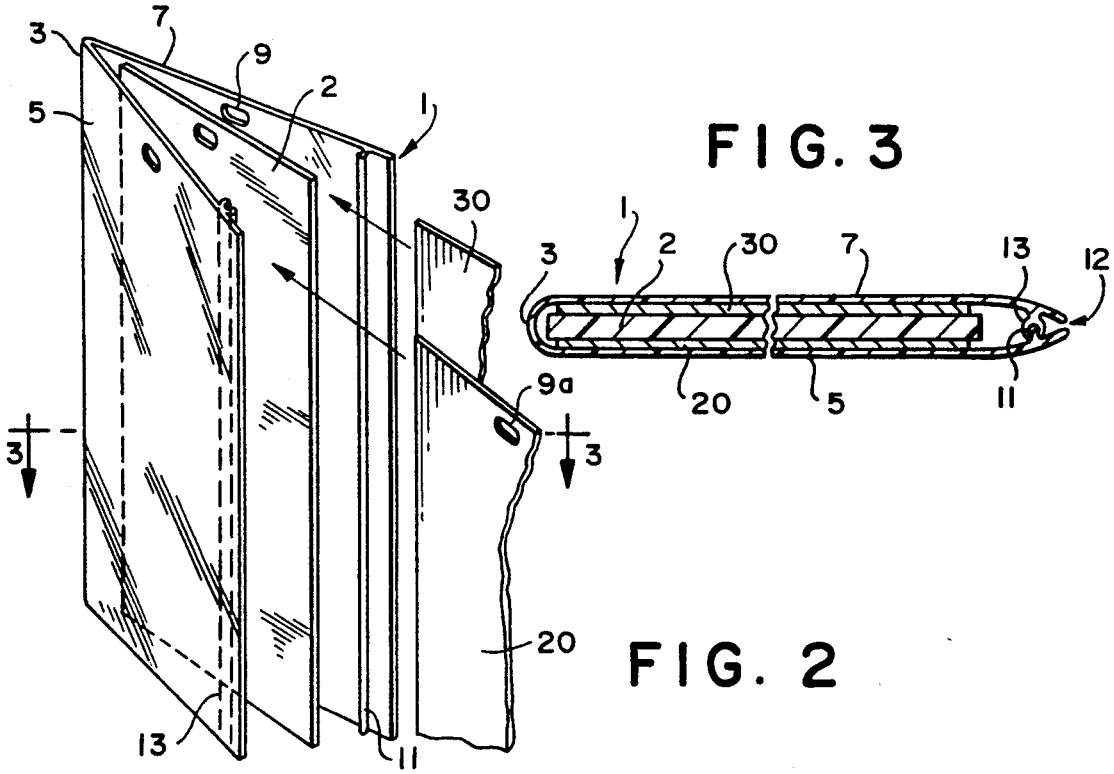
FIG. 3
FIG. 2

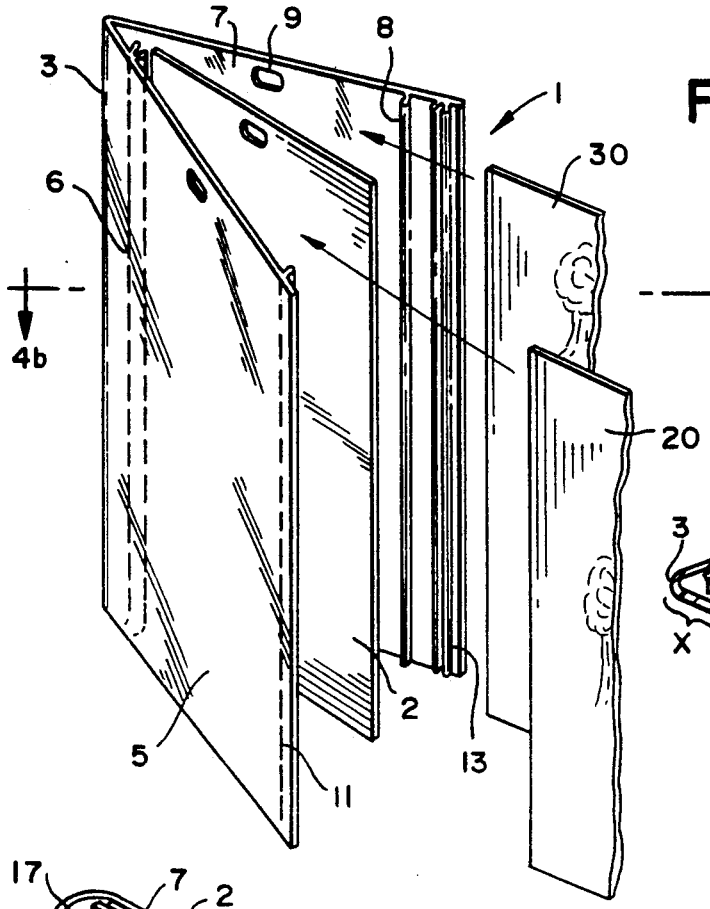
FIG. 4a
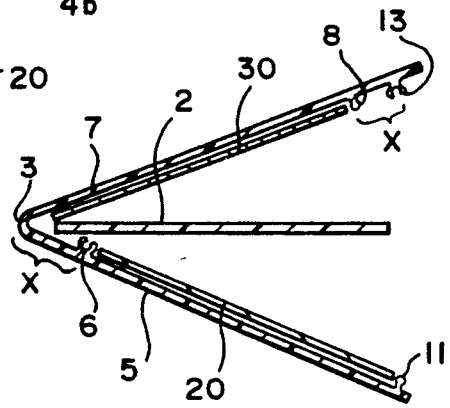
FIG. 4b
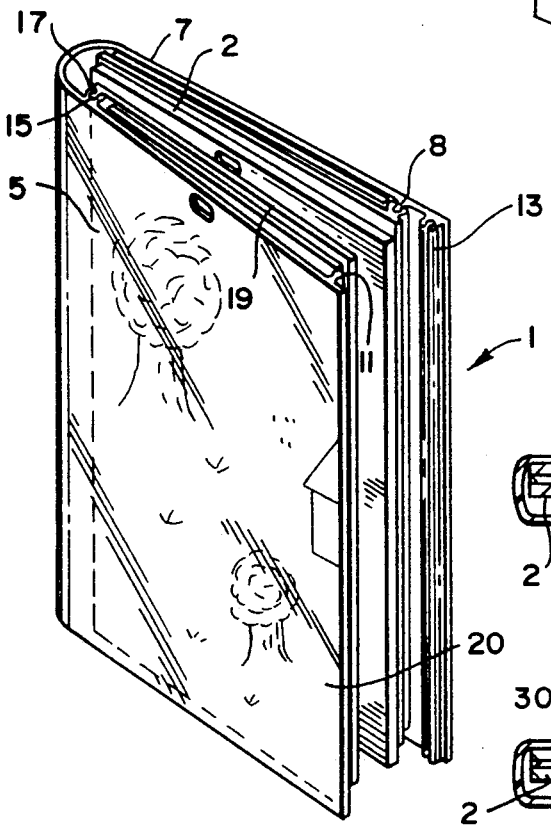
FIG. 5a
FIG. 5b
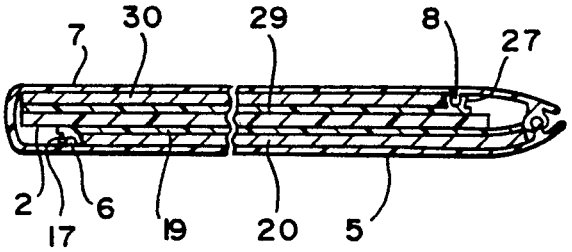
FIG. 5c
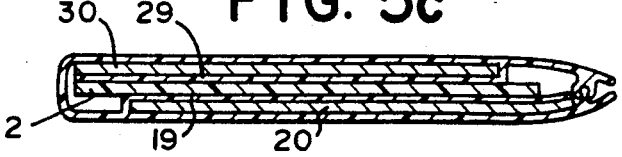

UNIVERSAL COVERING CASE AND METHOD FOR MODIFYING EXISTING BLIND ASSEMBLIES

RELATED U.S. APPLICATION

This application is a continuation-in-part of pending U.S application Ser. No. 07/864,239, filed Apr. 6, 1992, now abandoned.

FIELD OF INVENTION

The present invention relates to a universal covering case and method for modifying or altering any existing vertical or horizontal blind assembly. The universal covering case comprises a transparent case which is designed to individually enclose a slat of an existing blind assembly and further accommodates at least one decorative insert, thereby creating a multiple-layer "sandwich" effect, hereinafter sometimes referred to as the "louver". The decorative insert may be composed of any web material, such as paper, fabric, plastic film and the like, which provides the desired decorative effect. The universal covering case can be easily and quickly installed onto any existing louver assembly without the use of tools or special skills.

BACKGROUND OF THE INVENTION

Vertical and horizontal blind assemblies, such as color-coordinated or fabric-covered vertical blinds, mini-blinds, Roman blinds and the like, are well known as means of covering window and doors. Such blind assemblies not only offer the consumer privacy when said blind assemblies are in the closed position, but also provide the consumer with a means for enhancing the decor of a room. However, when the consumer desires to change the decor of a room, such re-decoration must take into consideration the style, color and design of the existing blind assembly. Under such circumstances, the consumer is either hindered or restricted in the manner in which the decor can be modified, or the consumer must remove the existing blind assembly and purchase and install a new system to conform with the new decor.

Various attempts have been made in the prior art to provide means for decorating blinds, louvers and the like, such as the vertical louver assemblies installed over windows, sliding glass doors, and the like. For example, louver systems have been offered wherein the louver comprises slots or flanges, typically along the longitudinal edges of the louver, in order to accommodate a decorative material, such as wall paper, textile materials etc., as disclosed in U.S. Pat. Nos. 4,049,038, 4,434,834, 4,519,435, and 5,141,042. However, these attempts are costly in that the consumer must purchase the specially designed louvers and install them. Further, if louvers are already in place, the consumer must first remove and discard the existing louvers and repair the walls where the previous fixtures were mounted, before installing the newly-purchased louvers. In addition, once the newly-purchased louvers are installed, if the consumer later desires to change the decorative effect, he/she would either be required to discard and re-purchase part of the louver, or undertake the tedious task of stripping and replacing the already applied wallpaper or decorative material.

Another known approach to decorating louvers has been the use of tubes or envelopes in which a fabric material can be slipped over existing louvers to provide decorative covers. Such fabric covers are disclosed in U.S. Pat. Nos. 5,101,876 to Zak and 4,911,220 to Hiller. These fabric covers address some of the aforementioned problems associated with purchasing and installing new louvers and fixtures. However, their appeal is limited insofar as the use of a homogenous fabric is required, thereby limiting the potential artistic design that can be created to a single color or a muted pattern. Further, installation may be time-consuming and changing the fabric material requires disassembling the entire louver system.

Another solution to modifying existing blind assemblies is offered in U.S. Pat. No. 5,105,870 to Merjane wherein a transparent blind slat is disclosed which comprises two transparent plastic slats that snap together. A decorative strip can be inserted and retained between the two slats. Although Merjane's blind slats addresses the problem of replacing the decorative insert, it does not utilize the existing slats of the blind assembly, but rather, replaces them, thereby requiring the dismantling and discarding of any existing louvers. Additionally, Merjane's blind slat system offers the consumer only limited creative design due to the overlapping of the blind slats.

No solution of modifying or altering existing blind assemblies has been offered which utilizes the existing slats and hardware of the blind assembly and provides for the creation of an infinitesimal number of decorative effects and the generation of any integrated or complete image.

SUMMARY OF THE INVENTION

The present invention relates to a universal covering case and method for modifying or altering any existing vertical or horizontal blind assembly. The universal covering case comprises a transparent case which is designed to individually enclose a slat of an existing blind assembly, thereby creating a three-layer "sandwich" effect, wherein the slat forms the middle layer. At least one decorative insert is positioned between the slat and the transparent covering case, thereby creating a multi-layer "sandwich" effect, hereinafter sometimes referred to as the "louver". The decorative insert may be composed of any web material, such as paper, fabric, plastic film and the like, which provides the desired decorative effect. The universal covering case can be easily and quickly installed onto any existing louver assembly without the use of special tools or exceptional skills.

It is an object of the present invention to provide a universal covering case and method for modifying or altering any existing horizontal or vertical blind assembly.

It is a further object of the present invention to provide a universal covering case which can be installed onto an existing horizontal or vertical blind assembly without the use of tools or special skills.

It is another object of the present invention to provide a universal covering case and method which utilizes the structural components of an existing horizontal or vertical blind assembly, including the track system, and does not require the modification or elimination of any elements or fixtures thereof.

It is still another object of the present invention to provide a universal covering case and method which is designed to easily accomodate a decorative insert in order to change or modify the decor of a room or the outside appearance of a window or door expanse.

It is an additional object of the present invention to provide a universal covering case and method wherein decorative inserts can be simply and quickly changed or replaced without dismantling and re-installing the entire covering case.

It is yet another object of the invention to provide a universal covering case and method wherein each decorative insert element constitutes a partial strip or section of an integrated or complete image such that the array of installed louvers displays the integrated or complete image.

It is still another object of the present invention to provide a universal covering case and method wherein the decorative inserts constitute partial strips or sections of an enlarged picture, photograph, or other design.

It is an additional object of the present invention to provide a universal covering case which is especially adapted to position a decorative insert, such as a partial strip or section of an integrated or complete image, within the covering case in such a manner that the partial images do not overlap when the louvers are in a closed to half-closed position, thereby allowing the integrated or complete image to be viewed in its entirety.

It is another object of the present invention to provide a universal covering case and method wherein both sides of the blind assembly are provided with complete and integrated images and either image can be viewed in its entirety from the same vantage point simply by pivoting the existing track 180 degrees.

It is a further object of the present invention to provide a universal covering case and method which is adapted to retain more than one decorative insert in each covering case, thereby enabling the user to simply and quickly create new decorative displays.

It is an additional object of the present invention to provide a universal covering case and method wherein an integrated or complete image of any design can be chosen or created by the user to provide images of landscapes, city sky lines, seasonal themes, commercial advertising messages, logos and the like.

It is another object of the present invention to provide a universal covering case installation kit comprising a plurality of preselected and prearranged decorative inserts.

Additional objects, advantages and novel features of the invention will be set forth in part in the description which follows, and in part will become apparent to those skilled in the art upon examination of the following specification or may be learned by practice of this invention.

These and other objects of the invention are achieved by providing a universal covering case for existing blind assemblies comprising an elongated body having sufficient width and length to cover any size slat used in blind assemblies, said body having a first face, a second opposing face (hereinafter sometimes referred to as front cover panel and back cover panel), wherein said first and second faces are essentially of the same dimensions and are joined along one longitudinal edge to form a spine, means to secure the universal covering case to the existing blind assembly, and means to close and fasten the cover panels of said case over both the existing slat of the blind assembly and at least one decorative insert.

In the simplest embodiment, a decorative insert is placed on one or both sides of the slat by any suitable means. For instance, the decorative insert may be provided with a slot or hole in its upper portion corresponding to the slot or hole in the slat which engages the existing blind assembly. Less preferably, the decorative insert may be adhered to the slat, for example, with glue, tape and the like. Once the insert is positioned on the slat, the covering case is installed over the thus-decorated slat to form a louver. The universal covering case may be installed onto any existing vertical blind assembly by means of a central slot or hole located at the upper portion of both cover panels, said slot or hole corresponding to the hooking mechanism of the blind assembly from which the existing slats are hung. The opposing faces or cover panels of the covering case are closed and fastened over both the existing slat of the blind assembly and at least one decorative insert by any suitable means, such as snaps, ties, tapes, Velcro, and the like. In the embodiments disclosed and discussed herein, a simple snapping means, preferably a tongue and groove fastening means is integrally molded along the longitudinal edge of each panel, opposite the longitudinal edge forming the spine. However, any suitable means of fastening the cover panels is considered to be within the scope of this invention.

In a preferred embodiment, a lateral positioning rib is molded on the inner side of one or both cover panels to provide consistent, non-overlapping positioning of the decorative insert within the louver with minimal or no adhesive means.

In another preferred embodiment, the lateral positioning rib is adapted to receive an elongated retaining flap. The flap is designed to cooperate with the cover panel in a parallel and longitudinal dimension such that the decorative insert is positioned between the transparent covering case panel and the elongated retaining flap. In this manner, more than one decorative insert can be positioned, on the same side of the slat, within the universal covering case. In an alternate embodiment, the elongated retaining flap may be integrally molded with the lateral positioning rib to form a leave which cooperates with the covering case panel.

In another preferred embodiment, the present invention provides a universal covering case installation kit, comprising a set of covering cases modified with elongated retaining flaps on one or both covering case panels and a plurality of pre-selected and pre-positioned decorative inserts.

BRIEF DESCRIPTION OF THE DRAWINGS

The present invention will be better understood with reference to the appended drawing sheets, wherein:

FIG. 1 shows a frontal perspective of the universal covering case of the present invention which has been installed onto a conventional vertical blind assembly, displaying an enlarged photographic image of a suburban neighborhood;

FIG. 2 is an open perspective of a simple embodiment of the universal covering case of the present invention;

FIG. 3 is a transverse cross sectional view of the universal covering case taken along the lines 3—3 of FIG. 2;

FIG. 4*a* is an open perspective of a preferred embodiment of the universal covering case of the present invention depicting the lateral positioning means;

FIG. 4*b* is a transverse cross-section of the universal covering case taken along the lines 4*b*—4*b* of FIG. 4*a*, and additionally shows a decorative insert in position;

FIG. 5*a* is a cut-away perspective of another preferred embodiment of the louver additionally including two detachable retaining flaps;

FIG. 5*b* is a cross section of the louver shown in FIG. 5*a*;

FIG. 5*c* is a cross section of an alternate embodiment of FIG. 5*b* wherein the elongated retaining flaps are integrally molded with the lateral positioning ribs;

DETAILED DESCRIPTION

Figure 6:
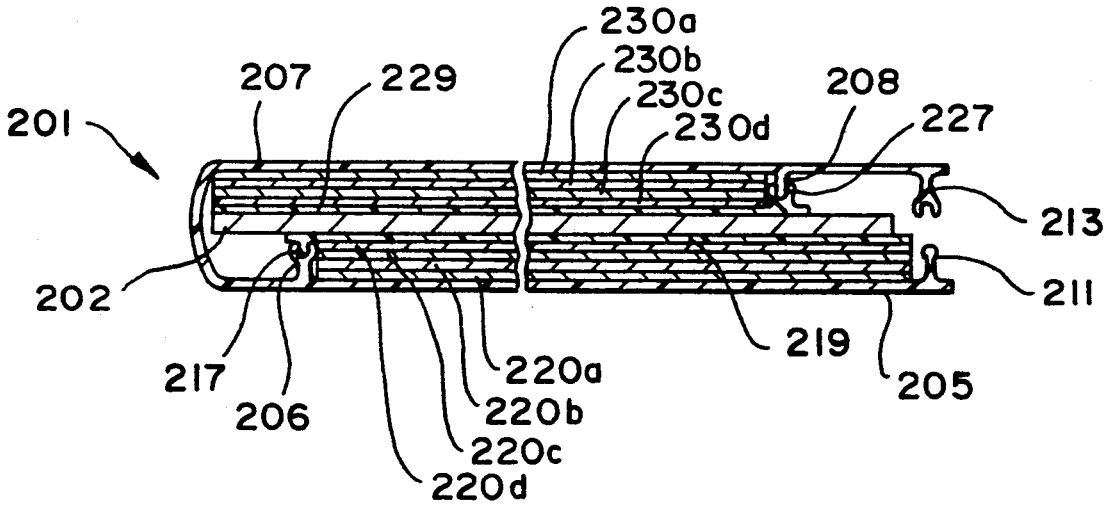
FIG. 6 is a cross-section of the universal covering case of the present invention, depicting a plurality of decorative inserts maintained within said case, and further illustrates the universal installation kit of the present invention.

The present invention relates to a universal covering case and method for modifying or altering any existing vertical or horizontal blind assembly The universal covering case comprises an elongated body having sufficient width and length to individually enclose a slat of an existing blind assembly, thereby creating a three-layer "sandwich" effect, wherein the slat forms the middle layer. At least one decorative insert is positioned between the slat and the covering case, thereby creating a multi-layer "sandwich" effect, hereinafter sometimes referred to as the "louver". The decorative insert may be composed of any web material, such as paper, fabric and the like, which provides the desired decorative effect. The decorative insert is preferably in the form of a partial strip or segment of an integrated or complete image such that the array of installed louvers displays an integrated or complete image formed by the partial images.

The universal covering case and method of the present invention can be installed onto any existing blind assembly. Solely for the purposes of illustration and discussion, the remainder of the specification will be directed to the installation of the universal covering case onto an existing vertical blind assembly, as broadly shown in FIG. 1 and described hereinafter. However, it will be obvious to those skilled in the art that the universal covering case of the present invention can be installed onto any blind or louver assembly with only minor design modifications thereto.

Referring to FIG. 1, a vertical blind assembly, generally denoted A, is shown comprising an array of vertical louvers VL suspended from a horizontal support structure H. The vertical louvers VL represent the resulting blind assembly after installation of the universal covering case of the present invention. Thus, FIG. 1 illustrates a vertical blind assembly which has been modified by the present invention to present a complete, integrated image of a suburban neighborhood.

As in FIGS. 2 & 3, the universal covering case 1 comprises an elongated body having a first face (or front cover panel) 5 and a second opposing face (or back cover panel) 7 wherein said first and second faces are essentially of the same dimensions and are joined along one longitudinal edge to form a spine 3. The spine 3 acts like a hinge allowing the user to open and close the covering case. The covering case is of sufficient width and length to encase a slat 2. Located at the upper portion of each cover panel is a central slot or hole 9, corresponding with the slot or hole in existing slat 2, in order to attach the covering case to the existing blind assembly. The universal covering case further comprises means for fastening the cover panels 5 and 7 to one another along the longitudinal edge of each panel opposite the longitudinal edge forming the spine. As best shown in FIG. 3 a simple snap-lock fastening means, generally denoted 12 is provided wherein a tongue 11 is integrally molded along the longitudinal edge of front cover panel 5 and a groove 13 is integrally molded along the longitudinal edge of cover panel 7.

The covering case 1 may be made of any material which is capable of encasing a slat and displaying a decorative insert. Preferably, the covering case is composed of a transparent extrudable polymer material. Other case materials suitable for use in the present invention may be used for various creative effects and include, but are not limited to, translucent, tinted, and/or refractive materials. Further, the material may be UV-treated.

As shown in FIG. 3, one or more decorative inserts 20, 30 may be positioned between slat 2 and cover panels 5 and 7 respectively. The decorative insert may be made of any web material that provides the desired decorative intent, including, but not limited to paper, fabric, plastic film and the like. The width and height of the decorative insert is adapted to conform with the slat of the existing blind assembly. As described in detail hereinafter, if it is desired to prevent overlapping of the decorative inserts when the blind assembly is in the closed or half-closed position, the decorative insert should be of less width than the standard slat. For instance, typically all conventional vertical blind assemblies sold today comprise standard slats of 3.5 inches. Hence, a typical insert for such a standard slat would be 3 inches wide.

The decorative inserts may comprise partial strips or segments of any conceivable larger, integrated or complete image, pattern or design. For instance, turning again to FIG. 1, it can be seen that each decorative insert 20 constitutes a strip of a partial image, the complete image of which is a city sky line. When a full array of decorative inserts 20 is installed onto an existing blind assembly using the universal covering case and method of the present invention, a complete and integrated image of a city sky line is displayed. A complete and integrated image may be provided by any suitable means, such as wallpaper, fabric, photographic enlargements, painting, printing, textile and the like. In a preferred embodiment, the user selects a favorite photograph which is enlarged to accomodate the size of an existing window or door expanse, and the enlargement is cut into strips, thereby forming the decorative inserts.

The universal covering system of the present invention is quite easy and simple to install, without the use of tools or special skills. The user places a decorative insert 20 on the slat 2 of the existing blind assembly by any suitable means, such as hanging the decorative insert 20 onto the existing track by slot or hole 9*a*. The universal covering case is positioned over the thus-decorated slat 2 by lining up the central slots or holes 9 and the covering case is snapped closed, thereby forming a louver. Thus, the louver is simply attached to the hooking mechanism of the existing blind assembly A.

Once installed, the array of louvers forms a complete or integrated image or other design on one o both sides of the blind assembly. When it is desired to change the displayed image on either the front or back side of the blind assembly, the universal covering case does not have to be removed. Instead, the user simply opens the snap-lock fastener, removes the current decorative insert out of the covering case, and positions a new decorative insert in its place.

Conventional vertical blind assemblies typically comprise louvers or blinds which are designed to overlap one another when they are pivoted to the closed position, in order to maximize privacy. However, such overlap presents particular problems when it is desired to utilize decorative inserts constituting partial strips or sections of images of photographs, panorama or other designs in order to obtain the complete and integrated image when the blind assembly is closed. In other words, if the decorative inert is sized to be of the same width as the slat, a portion of the partial image would be hidden from view when the louvers are closed. As a result, the complete and integrated image (e.g. a city sky line) could not be created and viewed in its entirety.

Consequently, precision is required in the abutment of each partial image, design or segment, such that when the covering system of the present invention is viewed with the blinds in the closed to half-closed position, there is no overlap among the decorative inserts, such as shown in FIG. 1.

In the embodiment shown in FIG. 3, the decorative inserts 20 and 30 are placed over the slat 2 and carefully positioned to prevent overlap. In a preferred embodiment of the present invention, as illustrated in FIGS. 4*a* and 4*b*, the problem of overlapping decorative inserts is avoided by incorporating a means to position the decorative insert in the universal covering case 1. As shown in FIGS. 4*a* and 4*b*, a unique positioning means is provided by lateral positioning ribs 6 and 8. Lateral positioning rib 6 is integrally molded on the inner side of front panel 5 at a distance X from spine 3 and lateral positioning rib 8 is integrally molded on the inner side of back panel 7 at a distance X from groove 13. Both ribs 6 and 8 extend lengthwise along the inner sides of panels 5 and 7. The lateral positioning ribs are designed in such a manner that the decorative insert can be firmly positioned within the covering case. Decorative insert 20 is positioned between rib 6 and the projecting ridge formed by tongue 11. Similarly, decorative insert 30 is positioned between rib 8 and spine 3. The distance X corresponds to the amount of overlap from one louver to the next when the louvers are in a fully closed position.

Referring to FIG. 4*b*, a decorative insert 20 is laterally positioned for precise alignment with an adjacent decorative insert, and is also prevented from any lateral shifting, by virtue of the lateral positioning rib 6 and tongue 11. The result of such positioning is the complete and integrated image, as viewed in FIG. 1, formed from the array of installed vertical louvers each of which constitutes a partial image strip or segment, with no overlap or gaps effecting the visual image. At the same time, the louvers of the blind assembly do overlap in the closed position by a distance X, thereby preserving and maintaining the privacy feature.

FIGS. 5*a* and 5*b* show another preferred embodiment of the present invention, wherein the universal carrying case 1 further comprises at least one elongated retaining flap, designed to cooperate with the cover panel in a parallel and longitudinal dimension such that the decorative insert is positioned between the cover panel and the elongated retaining flap. As best seen in FIG. 5*a*, the lateral positioning ribs 6 and 8 are adapted to receive an elongated retaining flap via tongue-and-groove fastening means, wherein each rib is designed to function as a tongue. Elongated retaining flaps 19 and 29 are formed with grooves 17 and 27 at one longitudinal edge thereof, said grooves corresponding to said tongues of the lateral positioning ribs 6 and 8 respectively. After at least one elongated retaining flap has been fitted to the corresponding lateral positioning rib, one or more decorative inserts can be maintained in a controlled manner in the space between the flap(s) and the cover panel(s) of the covering case.

In an alternative embodiment, the elongated retaining flap may be integrally molded with the lateral positioning ribs.

As illustrated in FIG. 6, the incorporation of the elongated retaining flap also affords the universal covering case 201 with the capability of storing more than one decorative insert on the same side of the slat 202. A number of decorative inserts 230*a*, 230*b*, 230*c*, 230*d* may be stacked he slat 202 and between the retaining flap 229 and cover panel 207. Decorative insert 230*a*, in the outermost position, is displayed through the cover panel 207. Each louver would contain a similar stack of decorative inserts, each decorative insert being a partial strip or section of an integrated or complete image, design or the like. In this manner, when the user wishes to display a different integrated or complete image, the user simply opens the covering case and removes the outermost decorative insert from the louver. By removing the corresponding inserts from each louver, a new image is created.

The present invention also provides a universal covering case installation kit wherein a plurality of decorative inserts are pre-selected and pre-positioned in each case. As viewed in FIG. 6, the installation kit comprises a universal covering case 201, having front and back cover panels 205 and 207, fastening means 211 and 213, lateral positioning ribs 206 and 208, retaining flaps 219 and 229 and further comprising a slat 202. Decorative insert sets 220*a–d* and 230*a–d* are pre-selected and pre-positioned within the case 201. The decorative inserts either may be individually positioned one on top of another, or may be bound together at the upper edge, similar to a calendar. Although four inserts per set are shown on each side of the slat, any number of inserts can constitute a set, depending upon the thickness of the web material used to produce the decorative inserts and the size of the covering case. Each set of decorative inserts comprises one or more classes of decorative inserts, that is, decorative insert 220*a*, 220*b*, 220*c* etc. each is part of a separate class. Each class represents an integrated or complete image for visual display when the louvers are closed or half-closed.

Each set of decorative inserts may comprise classes of related or unrelated images or designs. For examples, a set may represent a series of special occasions, such as holidays, the months of the year, seasons, different city skylines and the like. Additionally, each set could include cartoon characters for display in a child's room. Or each set could comprise a series of advertisements, promotions, commercial messages and logos or the like.

The universal covering case and method of the present invention literally can be used to modify or alter any existing blind assembly. It provides the opportunity for the merchant to convert storefront windows and doors with commercial advertisement and business logos, and offers the homeowner an infinite number of options for redecorating a room with a variety of designs, colors, fabrics and the like, displaying city sky lines and other panorama, enlarged family photographs, children's posters, learning aids, outdoor viewing of holiday themes and the like.

While particular embodiments of the invention have been described, it will be understood, of course, that the invention is not limited thereto, and that many obvious modifications and variations thereof can be made, and that such modifications and variations are intended to fall within the scope of the appended claims.

What is claimed is:

1. A louver assembly comprising (1) an existing slat of a blind assembly and (2) a universal covering case comprising an elongated body having sufficient width and length to cover said existing slat, said body comprising:

a) first and second panels, wherein said first and second panels are essentially of the same dimensions and are joined along one longitudinal edge to form a spine;

b) means to secure the universal covering case to said blind assembly; and c) means to close and fasten the first and second panels of said case over said existing slat.

2. The universal covering case according to claim 1, wherein the case is composed of an extrudable plastic material.

3. The universal covering case according to claim 2, wherein the plastic material is a UV-treated transparent material.

4. The louver assembly according to claim 1, wherein said universal covering case further comprises at least one lateral positioning rib.

5. The universal covering case according to claim 4, further comprising at least one elongated retaining flap.

6. The universal covering case according to claim 5, wherein said elongated retaining flap is detachably joined along one longitudinal edge to said lateral positioning rib.

7. The universal covering case according to claim 5, wherein said elongated retaining flap is integrally molded along one longitudinal edge with said lateral positioning rib.

8. The louver assembly according to claim 1, additionally comprising at least one elongated decorative insert positioned between a panel of said covering case and said existing slat.

9. The universal covering case according to claim 4, additionally comprising at least one elongated decorative insert positioned between a panel of said covering case and the existing slat, wherein said at least one elongated decorative insert is positioned laterally alongside said lateral positioning rib.

10. The universal covering case according to claim 5, additionally comprising at least one elongated decorative insert positioned between a panel of said covering case and said elongated retaining flap.

11. The universal covering case according to claim 10, wherein a plurality of decorative inserts are positioned between at least one said elongated retaining flap and one panel of the covering case.

12. The louver assembly according to claim 1, wherein said means of closing and fastening said first and second panels is a tongue and groove snap-lock fastening means.

13. A method of modifying existing blind assemblies, comprising:

a) placing at least one decorative insert over at least one face of an existing slat of a blind assembly, thereby forming a decorated slat;

b) positioning a covering case over the decorated slat; and c) closing and fastening said case, thereby forming a louver; wherein, said covering case comprises an elongated body having sufficient width and length to cover said existing slat, said body including: first and second panels, wherein said first and second panels are essentially of the same dimensions and are joined along one longitudinal edge to form a spine; means to secure the universal covering case to the existing blind assembly; and means to close and fasten the first and second panels of said case over said existing slat of said blind assembly.

14. A method according to claim 13 wherein, said covering case further comprises at least one lateral positioning rib, said rib being positioned on the inside face of at least one of said panels and being disposed parallel to and inwardly from the longitudinal edges of said panels, and wherein, said at least one decorative insert is positioned laterally alongside said positioning rib of said covering case.

15. The method according to claim 14 wherein, said covering case further comprises at least one elongated retaining flap, and wherein said at least one decorative insert is positioned between one panel of said covering case and said retaining flap.

* * * * *